US005680105A

United States Patent [19]

Hedrick

[11] Patent Number: 5,680,105

[45] Date of Patent: Oct. 21, 1997

[54] LOST OBJECT LOCATING SYSTEM

[76] Inventor: Gary Hedrick, 2052 Sinking Creek Rd., London, Ky. 40741

[21] Appl. No.: 568,262

[22] Filed: Dec. 6, 1995

[51] Int. Cl.[6] ..... G08B 13/14

[52] U.S. Cl. ..... 340/571; 340/539; 340/568; 340/693; 340/825.36; 340/825.49; 341/176

[58] Field of Search ..... 340/539, 693, 340/825.49, 568, 571, 825.36, 692; 341/126

[56] References Cited

U.S. PATENT DOCUMENTS

| | | | |
|---|---|---|---|
| 4,383,242 | 5/1983 | Sassover et al. | 340/543 |
| 4,476,469 | 10/1984 | Lander | 340/825.49 |
| 4,922,229 | 5/1990 | Guenst | 340/572 |
| 5,132,660 | 7/1992 | Chen. et al. | 340/428 |
| 5,204,657 | 4/1993 | Prosser | 340/568 |
| 5,278,556 | 1/1994 | Oh | 340/988 |
| 5,294,915 | 3/1994 | Owen | 340/539 |

*Primary Examiner*—Jeffery Hofsass
*Assistant Examiner*—Benjamin C. Lee
*Attorney, Agent, or Firm*—Goldstein & Associates

[57] ABSTRACT

An object locating system, for locating lost objects, comprising at least two response units, and at least two activation units. Each response unit corresponding to one of the objects. Each response unit having an RF receiver for receiving an encoded RF signal, a beeper, and a code program for enabling the beeper in response to the encoded RF signal. The response unit having a reset button for disabling the beeper after it has been enabled. The activation units each having a code which corresponds to the code program in one of the response units. The activation unit having an RF transmitter which generates the encoded RF signal to enable the beeper in one of the response units. Each of the response units are color coordinated to the activation unit having the corresponding code.

7 Claims, 2 Drawing Sheets

LOST OBJECT LOCATING SYSTEM

BACKGROUND OF THE INVENTION

1. Field of the Invention

The invention relates to a lost object locating system. More particularly, the invention relates to a system by which a finite number of objects are each tagged with a response unit. If one of the objects becomes lost, the response unit is signaled by a matching activation unit, and then emits an audible tone to indicate the location of the object.

2. Background and Prior Art

In our cluttered dwellings, small objects are easily lost. A small object can easily work its way under a couch cushion, under a book on a table, or on the floor behind furniture.

Car keys and house keys are often the most difficult to locate when we are on our way out the door. People often are late to work, school, and important appointments simply because they had trouble locating their keys.

Other objects that are easily lost include television remote controls, portable telephones, check books, and purses. Misplacing these items will usually initiate a similarly frustrating and time wasting search.

While these units may be suitable for the particular purpose employed, or for general use, they would not be as suitable for the purposes of the present invention as disclosed hereafter.

SUMMARY OF THE INVENTION

It is an object of the invention to produce a lost object locating system which will allow a lost item to be quickly and easily located.

It is another object of the invention to provide a lost object locating system in which an easily lost item is tagged with a response unit, which will selectively emit an audible tone when signaled by a matching activation unit.

It is a further object of the invention that the activation unit is further comprised in an organization device for holding the object when not in use.

It is a still further object of the invention that the organization device further comprises a master activation unit which may be detached to look for lost objects attached to any of the response units.

It is yet a further object of the invention to provide a lost object locating system which may be inexpensively manufactured.

The invention is an object locating system, for locating lost objects, comprising at least two response units, and at least two activation units. Each response unit corresponding to one of the objects. Each response unit having an RF receiver for receiving an encoded RF signal, a beeper, and a code program for enabling the beeper in response to the encoded RF signal. The response unit having a reset button for disabling the beeper after it has been enabled. The activation units each having a code which corresponds to the code program in one of the response units. The activation unit having an RF transmitter which generates the encoded RF signal to enable the beeper in one of the response units. Each of the response units are color coordinated to the activation unit having the corresponding code.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
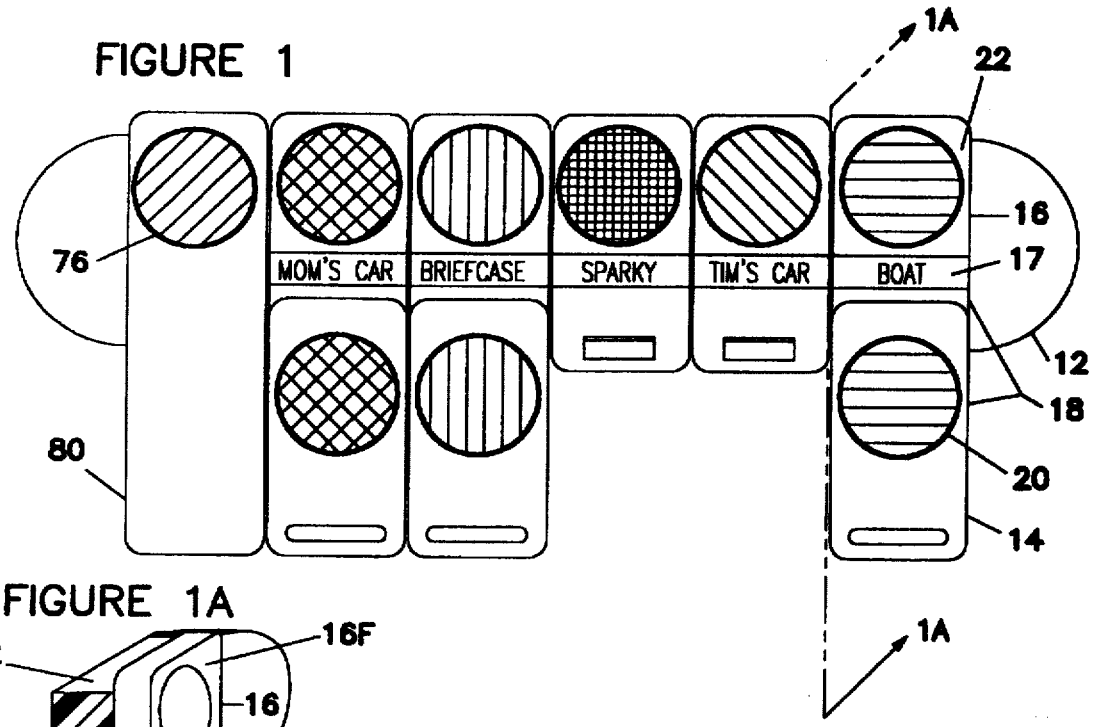
FIG. 1 is a front elevational view, illustrating the invention.

FIG. 1 illustrates an object locating system 10, comprising a master rack 12. Response units 14 and activation units 16 are mounted in pairs 18 on the rack 12. The response unit 14 and activation unit 16 in each pair 18 have a reset button 20 and an activation switch 22, respectively. The reset button 20 and activation switch 22 or each matched pair are color coordinated: i.e. they are the same color. The activation units 16 each have discriminating indicia 17 which names the object attached to the matching response unit 14. The discriminating indicia 17 may comprise a labe which allows for recordation of the name of the object attached to the matching response unit 14.

Figure 2:
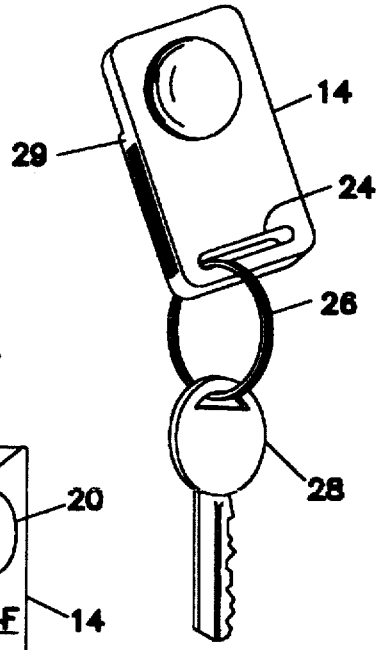
FIG. 2 is a perspective view, illustrating the response unit in use.

Referring to FIG. 2, each response unit 14 has a key ring aperature 24, for holding a key ring 26, which ultimately supports at least one key 28. The response unit 14 is substantially rectangular in shape, and includes audio vents 29 for allowing sound to propagate from within the response unit 14.

Figure 1A:
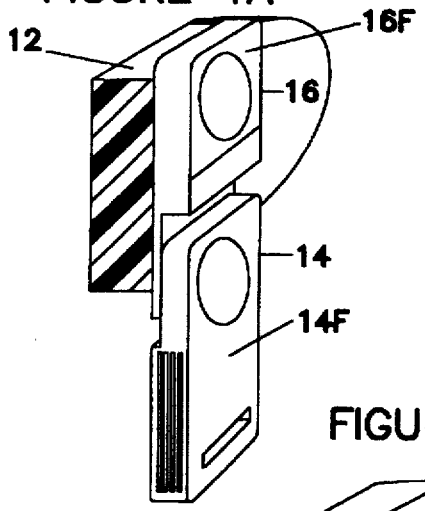
FIG. 1A is a perspective view, with parts broken away taken along line 1A—1A in FIG. 1, illustrating matched activation and response units.
Figure 1B:
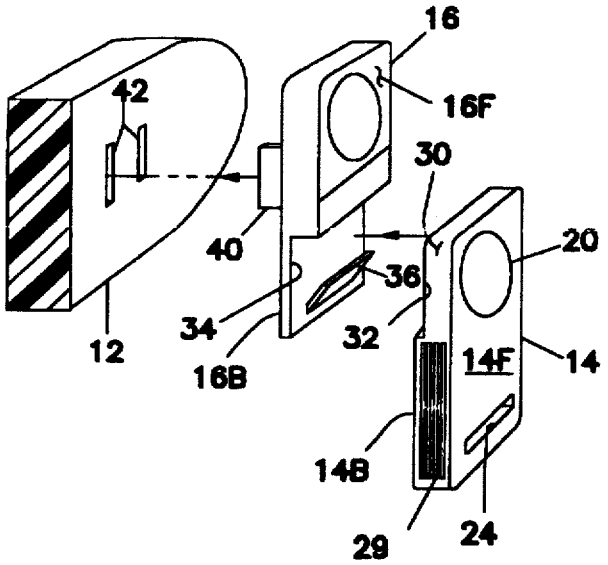
FIG 1B is a perspective view, with parts broken away, illustrating assembly and use of the invention.

Referring to FIG 1B, the response unit 14 has sides 30, wherein the audio vents 29 are attached. The response unit 14 also has a front 14F and a back 14B. The response unit 14 has a response unit thickness defined as the distance between the planes of the response unit front 14F and response unit back 14B. The aperature 24 extends fully from the front 14F to the back 14B. The reset button 20 is mounted on the front 14F, and a response unit indentation 32 is present in the back 14B opposite from the aperature 24.

The response unit 14, the activation unit 16, and the rack 12 all interlock. The activation unit 16 has an activation unit front 16F, an activation unit back 16B, and an activation unit thickness, defined as the dimension between the planes of the activation unit front 16F and back 16B. The response unit thickness should equal the activation unit thickness. The activation unit 16 has an activation unit indentation 34 on the activation unit front 16F. The activation unit 16 has a hook 36 located in the activation unit indentation 34 adapted to clip onto the response unit 14. Ideally, the response unit 14 mates with the activation unit 16, so that when mated the overall thickness is constant, as seen in FIG. 1A. Thus the sum of the response unit indentation 32 and activation unit indentation 34 should equal the thickness of the response unit and/or the activation unit, so that the activation unit front 16F and response unit front 14F are flush when mated together.

As illustrated in FIG 1B, the activation unit has key projections 40, which extend into key slots 42 in the rack, so that the activation units 16 are removably mountable on the rack 12. The key projections 40 may be electrically conducting, to allow activation circuitry to be contained within the rack 12, and to communicate to the activation circuitry the status of the activation switch 22 on the activation unit 16. As illustrated in FIG. 1A, the activation unit 16 is mounted on the rack 12, and the response unit 14 is mounted on the activation unit 16.

Figure 3:
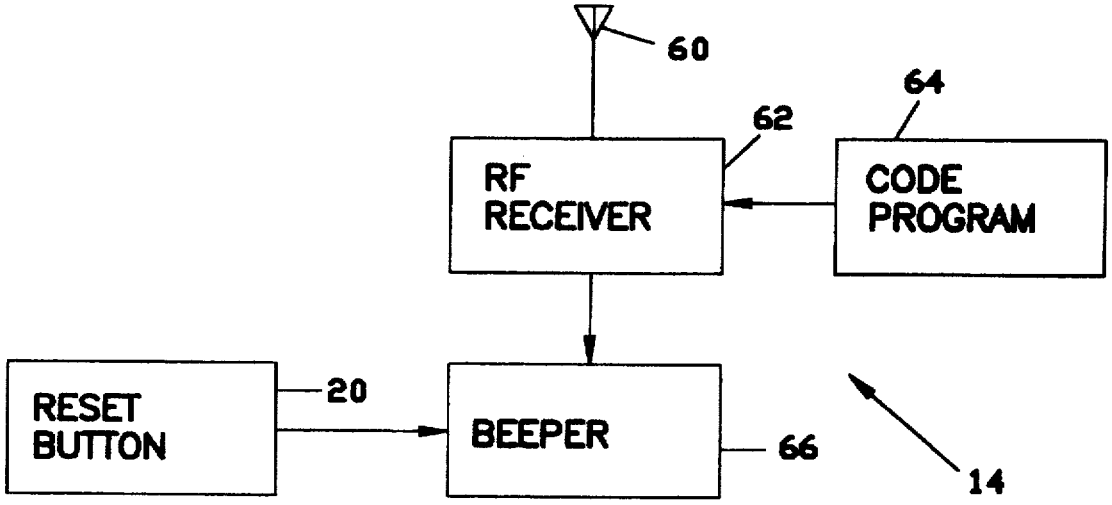
FIG. 3 is a block diagram, illustrating the major components of the response unit.

FIG. 3 is a block diagram, illustrating the response unit 14. The response unit comprises a receiving antenna 60, for receiving an encoded RF signal, and an RF receiver 62 for decoding the encoded RF signal under the scrutiny of a code program 64. When an RF signal modulated by a code matching the code program 64 is received, a beeper 66 is enabled to draw attention to the response unit 14 and the lost object attached thereto. The beeper 66 will continue to sound until disabled by the reset button 20. Ideally, the code program is an 8 to 64 bit binary code, for preventing false triggering.

Figure 4:
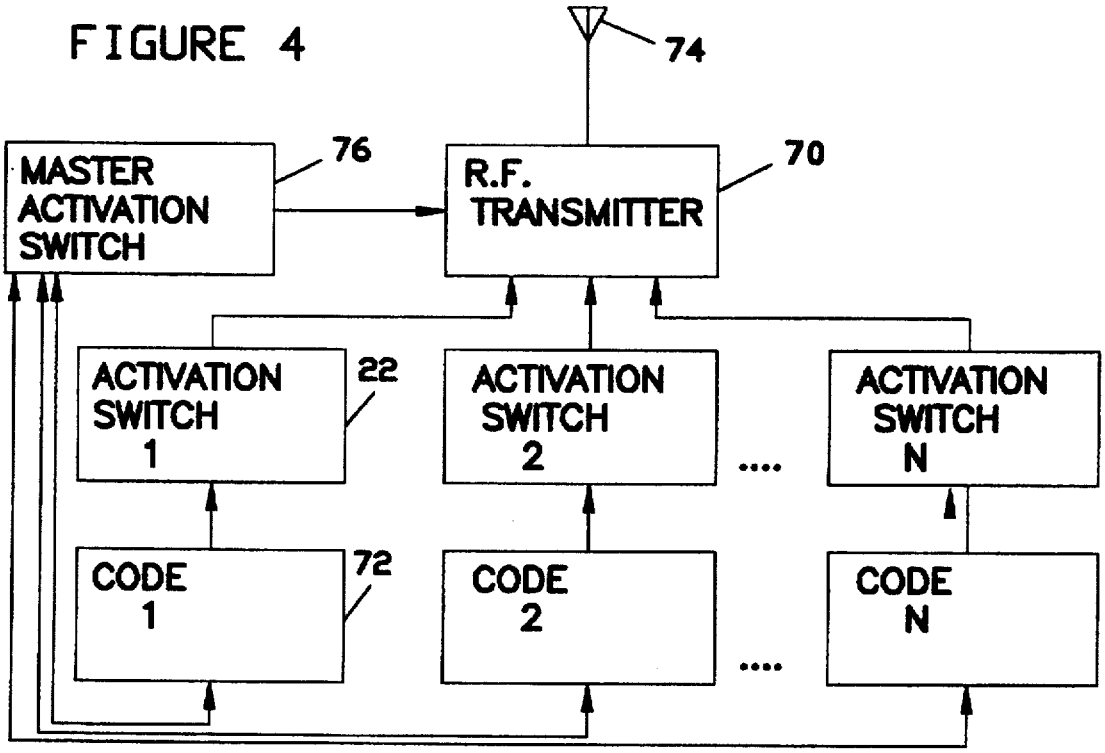
FIG. 4 is a block diagram, illustrating major components of the activation circuitry.

FIG. 4 is a block diagram of an embodiment of the activation circuitry. Broadly, when enabled by the activation switch 22, an RF transmitter 70 generates an encoded RF signal under the modulation of a code 72. The encoded RF signal is propagated by a transmitting antenna 74. As shown in FIG. 4, a plurality of activation switches 22 allow a plurality of codes 72 to be transmitted using the same RF transmitter 70. In addition, all codes 72 can be transmitted by the RF transmitter 70 in rapid succession through a master activation switch 76. In the embodiment illustrated in FIG. 4, the activation circuitry is contained within the rack, and the activation switches 22 are each located in separate activation units 16. The activation switches 22 communicate with the rest of the activation circuitry through the key projections 40.

In another embodiment, each activation unit 16 contains its own RF transmitter 70, code 72, activation switch 22, and transmitting antenna 74. In this embodiment, the activation units 16 may be detached from the rack 12, carried around and repeatedly activated by pressing the activation switch 22, to "find" the lost object attached to the response unit 14 having a code program 64 that matches the code 72 in the activation unit 16.

In addition, referring to FIG. 1, a master activation unit 80 may contain the RF transmitter 70, the master activation switch 76, and the codes 72 which correspond to all the code programs 64 contained in the response units 14. This master activation unit 80 can be detached from the rack 12 and the master switch 76 repeatedly enabled to "look" for any lost objects connected to any of the response units 14.

The lost object locating system is operated as follows: Each object is tagged with one of the response units 14. The response units may be conveniently stored on the rack 12 when not in use. However, when one of the objects becomes lost, the corresponding activation unit 16 is enabled by pressing the activation switch. The activation unit 16 transmits the encoded RF signal, which is detected by the response unit 14 having a matching code program. The beeper 66 in the response unit 14 begins to sound, drawing attention to the lost object. Once located, the reset button 20 on the response unit 14 is pressed to disable the beeper 66. If desired, the response unit 14 may be restored to the rack, and mounted to the corresponding activation unit 16. If all lost objects are sought to be located, the master activation switch 76 can be pressed to transmit encoded RF signals which would cause each of the response units 14 to enable their respective beepers 16.

What is claimed is:

1. An object locating system, for tagging a plurality of objects and selectively locating at least one of the objects, comprising:

at least two response units, the response units each having an aperture for attaching to one of the objects, the response units having an RF receiver for receiving an encoded RF signal, a beeper enabled by the RF receiver upon reception of the encoded RF signal, each response unit having a code program, the code program in each response unit distinct from the code program in the other response units, each response unit further comprising a reset button for disabling the beeper once the response unit has been located;

at least two activation units, each having a code which corresponds to the code program in one of the response units, each activation unit comprising an activation switch for enabling the encoded RF signal, the activation switch of each activation unit color coordinated to the reset button on the response unit having the code program that matches the code in the activation unit, and each activation unit comprising discriminating indicia which names the object attached to the matching response unit; and a rack, each of the activation units mounted onto the rack, the response units each selectively mountable onto the activation unit having the code which corresponds to the code program in one of the response units.

2. The object locating system as recited in claim 1, further comprising a master activation unit mounted to the rack, the master activation unit having a master activation switch, the master activation unit transmitting the codes for all the response units upon enablement of the master activation switch.

3. The object locating system as recited in claim 1, wherein each of the activation units have an activation unit front having an activation unit indentation having a hook, and each of the response units have a response unit back having a response units indentation which is attachable in the activation unit indentation, the response unit clipping onto the hook at the activation unit indentation.

4. The object locating system as recited in claim 3, wherein the response unit has a response unit front, the activation unit has an activation unit thickness and the response unit has a response unit thickness which is equal to the activation unit thickness, and wherein the sum of the response unit indentation and activation unit indentation is equal to the activation unit thickness so that when the activation unit and the response unit are mated, the response unit front is flush with the activation unit front.

5. The object locating system as recited in claim 4, wherein 1, wherein each activation unit front comprises an activation switch for enabling the encoded RF signal, each response unit front comprises a reset button for disabling the beeper once the response unit has been located, and the activation switch of each activation unit is color coordinated to the reset button on the response unit having the code program that matches the code in the activation unit.

6. The object locating system as recited in claim 5, wherein the master activation unit is selectively detachable from the rack.

7. The object locating system as recited in claim 6, wherein each activation unit further comprises discriminating indicia, which names the object attached to the matching response unit.

* * * * *